US010883711B1

(12) United States Patent
Xie

(10) Patent No.: US 10,883,711 B1
(45) Date of Patent: Jan. 5, 2021

(54) LAMP

(71) Applicant: SHENZHEN AURORA TECHNOLOGY CO., LTD., Guangdong (CN)

(72) Inventor: Qingbo Xie, Guangdong (CN)

(73) Assignee: SHENZHEN AURORA TECHNOLOGY CO., LTD., Shenzhen (CN)

( * ) Notice: Subject to any disclaimer, the term of this patent is extended or adjusted under 35 U.S.C. 154(b) by 0 days.

(21) Appl. No.: 16/681,806

(22) Filed: Nov. 12, 2019

(30) Foreign Application Priority Data

Jul. 15, 2019 (CN) ..... 2019 1 0633902

(51) Int. Cl.

| | |
|---|---|
| ***F21V 29/71*** | (2015.01) |
| ***F21V 29/83*** | (2015.01) |
| ***F21V 23/00*** | (2015.01) |
| ***F21S 45/43*** | (2018.01) |

(52) U.S. Cl.
CPC ..... *F21V 29/71* (2015.01); *F21S 45/43* (2018.01); *F21V 23/004* (2013.01); *F21V 29/83* (2015.01)

(58) Field of Classification Search
CPC ..... F21V 29/71; F21V 29/82; F21V 23/004; F21S 45/43; F21S 45/20; F21S 45/33; F21S 45/49; F21S 41/141
See application file for complete search history.

(56) References Cited

U.S. PATENT DOCUMENTS

| | | | | |
|---|---|---|---|---|
| 7,972,036 | B1 * | 7/2011 | Schach | F21V 23/0442 362/290 |
| 2008/0291631 | A1 * | 11/2008 | Hellinger | F21V 29/763 361/704 |
| 2012/0134150 | A1 * | 5/2012 | Catalano | F21K 9/233 362/231 |
| 2019/0211991 | A1 * | 7/2019 | Lessard | F21S 45/49 |

* cited by examiner

*Primary Examiner* — Anabel Ton

(57) ABSTRACT

The present disclosure relates to a lamp comprising a PCB board and an integrated heat dissipation device, wherein the PCB board is a double-sided PCB board on both sides of which are suitable for installing LED lamp beads, the PCB board has two heat dissipation edges arranged relatively to each other, the integrated heat dissipation device comprises a heat sink and two heat dissipation arms, wherein the heat dissipation arms and the heat sink are integrally formed with the medium, and the two heat dissipation arms are respectively fitted snugly with the two heat dissipation edges. The lamp provided by the present disclosure is assembled with a double-sided PCB board and an integrated heat dissipation device to improve the integration degree of the PCB board and the heat sink.

9 Claims, 4 Drawing Sheets

LAMP

CROSS REFERENCE TO RELATED APPLICATION

The present application claims priority to Chinese patent application No. 201910633902.1, entitled "Lamp", filed on Jul. 15, 2019, the entire content of which is incorporated herein by reference.

TECHNICAL FIELD

The present disclosure relates to the field of illumination technology, and in particular to a lamp and an automobile headlamp.

BACKGROUND

At present, LED automobile headlamps are widely used due to the advantages of energy saving and environmental protection, low light attenuation and low interference. The existing LED automobile headlamp adopts two PCB boards, and LED light beads are respectively installed on the front sides of the two PCB boards. A heat dissipation interlayer is arranged between the back sides of the two PCB boards, and the two PCB boards are in contact with the heat sink and the heat of the PCB boards is guided to the heat sink through the heat dissipation interlayer. This heat dissipation method has low heat dissipation efficiency and cannot fully take away the heat of the PCB boards, thereby affecting the service life of the lamp. Moreover, the thickness of the two PCB boards assembled at intervals is too large to meet the size requirements of the halogen lamp, and the optimal light type cannot be obtained. In addition, the existing split heat sink structure also seriously affects the heat dissipation efficiency and effect of the lamp.

SUMMARY

The embodiments of the present disclosure relate to a lamp, which can solve at least some of the defects in the prior art.

The embodiments of the present disclosure relate to a lamp comprising a PCB board and an integrated heat dissipation device, wherein the PCB board is a double-sided PCB board on both sides of which are suitable for installing LED lamp beads, the PCB board has two heat dissipation edges arranged opposite to each other, the integrated heat dissipation device comprises a heat sink and two heat dissipation arms, wherein the heat dissipation arms and the heat sink are integrally formed with the medium, and the two heat dissipation arms are respectively attaching to the two heat dissipation edges.

In one embodiment, the two heat dissipation arms are respectively riveted and assembled with the two heat dissipation edges.

In one embodiment, each of the two heat dissipation arms has a fitting groove, and the two heat dissipation edges are separately inserted into the two fitting grooves.

In one embodiment, the integrated heat dissipation device further comprises a heat dissipation fan, the heat dissipation fan is embedded in the heat sink.

In one embodiment, the heat sink has a hollow structure, a through end of the heat sink is blocked by a heat sink tail cover.

In one embodiment, the heat sink has a hollow structure, the PCB board is connected with a driving adapter board, the driving adapter board is accommodated in a hollow cavity of the heat sink.

In one embodiment, the substrate of the PCB board is a copper plate, an aluminum plate or a composite substrate.

In one embodiment, the PCB board has a thickness of 0.1 to 3 mm.

In one embodiment, the lamp further comprises a power connection structure, the power connection structure is disposed at the tail of the heat sink.

In one embodiment, the lamp further comprises a mounting structure suitable for detachably mounting to the lamp holder.

The embodiments of the present disclosure have at least the following beneficial effects:

the lamp provided by the present disclosure is assembled with a double-sided PCB board and an integrated heat dissipation device to improve the integration degree of the PCB board and the heat sink. Compared with the existing assembling manner by using two PCB boards and the heat sink, the present disclosure can effectively improve the heat dissipation efficiency, the integrated heat sink can reduce the number of heat switching between different media and different structures, improve the heat conduction efficiency, and further ensure the heat dissipation effect. Compared with the existing combination of two PCB boards, the double-sided PCB board has no additional interlayer and has a small thickness, the distance between the lamp beads installed on the front and back sides is closer, which is more in line with the original halogen lamp type.

BRIEF DESCRIPTION OF THE DRAWINGS

In order to more clearly illustrate the technical solutions in the embodiments of the present disclosure, drawings used in the description of the embodiments or the prior art will be briefly described below. Obviously, the drawings in the following description are some embodiments of the present disclosure. Those skilled in the art can also obtain other drawings based on these drawings without creative efforts.

DESCRIPTION OF THE EMBODIMENTS

Figure 1:
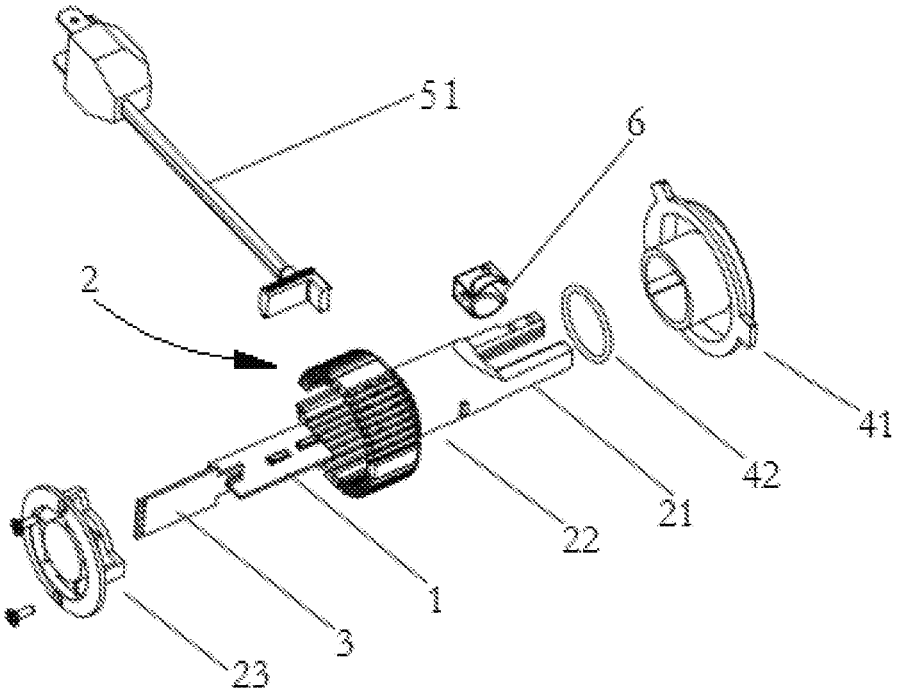
FIG. 1 is a schematic structural diagram of a lamp with a heat dissipation fan according to an embodiment of the present disclosure.

The technical solution in the embodiments of the present disclosure is clearly and completely described below with reference to the accompanying drawings in the embodiments of the present disclosure. Obviously, the described embodiments are merely a part of the embodiments of the present disclosure, rather than all of the embodiments. All other embodiments obtained by those skilled in the art based on the embodiments of the present disclosure without paying any creative efforts are within the scope of protection of the present disclosure.

Referring to FIGS. 1-7, the embodiments of the present disclosure provide a lamp comprising a PCB board 1 and an integrated heat dissipation device 2, wherein the PCB board 1 is a double-sided PCB board 1 on both sides of which are suitable for installing LED lamp beads, the PCB board 1 has two heat dissipation edges arranged relatively to each other, the integrated heat dissipation device 2 comprises a heat sink 22 and two heat dissipation arms 21, wherein the heat dissipation arms 21 and the heat sink 22 are integrally formed and they are made from the same medium, and the two heat dissipation arms 21 are fitted in such a way that they attach the two heat dissipation edges respectively.

The above PCB board 1 preferably comprises a copper substrate, an aluminum substrate or a composite substrate, and has good thermal conductivity.

The double-sided PCB board 1 is an existing device, and there are circuits disposed on both sides thereof, and LED lamp beads are installed according to the lighting requirements.

In one example, the above-mentioned PCB board 1 is a rectangular board, which has four edges comprising two long edges and two short edges. The two long edges disposed opposite to each other can be used as the above-mentioned heat dissipation edges for assembling with the two heat dissipation arms 21.

It can be seen that one of the heat dissipation arms 21 is attaching to one of the heat dissipation edges, and the other of the heat dissipation arms 21 is attaching to the other of the heat dissipation edges. Therefore, the two heat dissipation arms 21 are also disposed opposite to each other.

For the assembly structure of the heat dissipation edge and the heat dissipation arm 21, it is preferable that the heat dissipation arm 21 is attaching to both the heat dissipation sidewall at the heat dissipation edge and the PCB board on both sides and arranged thereon so as to ensure the contact area is large enough and the heat conduction efficiency is good enough.

Figure 5:
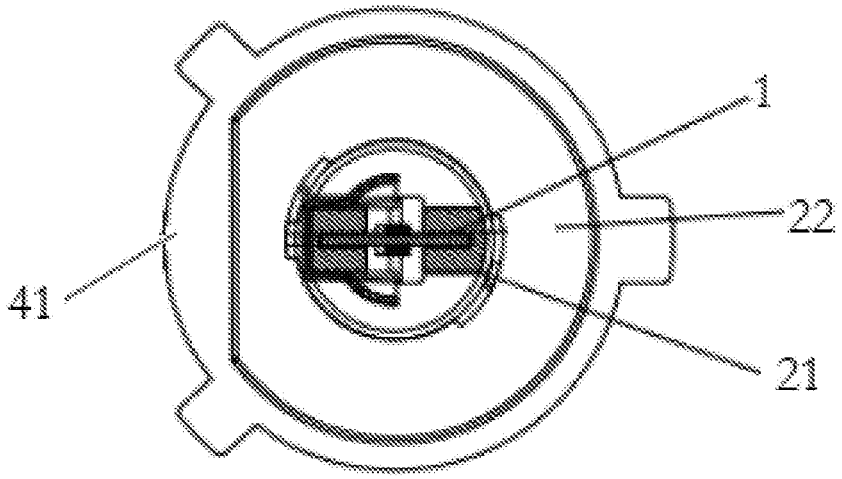
FIG. 5 is a top view of a lamp according to an embodiment of the present disclosure.
Figure 6:
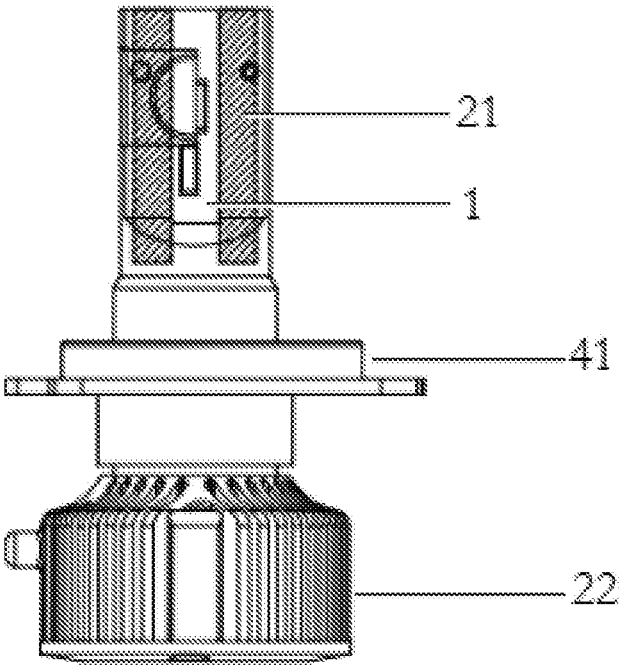
FIG. 6 and FIG. 7 are cross-sectional views of a lamp according to an embodiment of the present disclosure.
Figure 7:
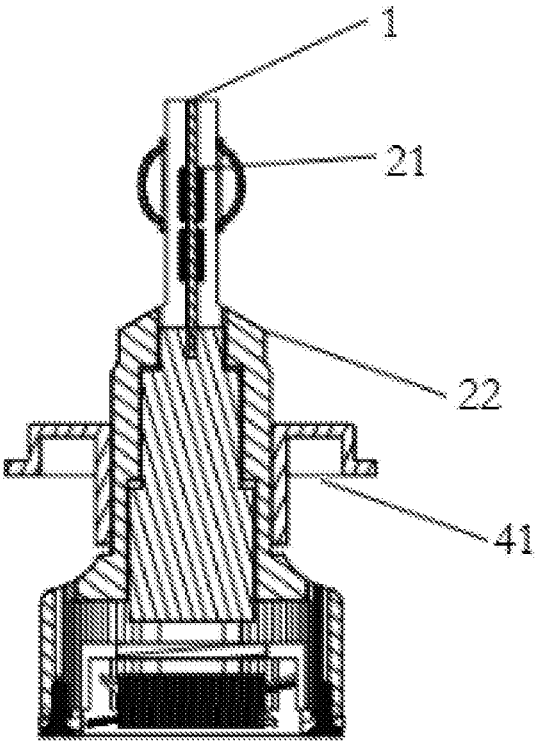

As shown in FIGS. 5-7, for the assembly manner between the heat dissipation arm 21 and the heat dissipation edge, it is preferable to adopt a riveting and assembly manner, and the heat dissipation arm 21 and the heat dissipation edge are closely contacting with each other and pressed together, and the thermal conductivity effect is better. In another embodiment, each of the two heat dissipation arms 21 has a fitting groove, and the two heat dissipation edges are respectively inserted into the two fitting grooves; furthermore, the thermal conductive adhesive can be painted between the heat dissipation arm 21 and the heat dissipation edge to ensure good heat dissipation effect.

For the above-mentioned integrated heat dissipation device 2, the heat dissipation arms 21 and the heat sink 22 are integrally formed and adopt the same thermal conductive medium, which can reduce the number of heat switching between different media and different structures, improve the heat conduction efficiency, and further ensure the heat dissipation effect.

The lamp provided by the present embodiment is assembled with a double-sided PCB board 1 and an integrated heat dissipation device 2 to improve the integration degree of the PCB board 1 and the heat sink 22. Compared with the existing assembling manner by using two PCB boards and the heat sink 22, the present embodiment can effectively improve the heat dissipation efficiency. Compared with the existing combination of two PCB boards, the double-sided PCB board 1 has no additional interlayer and has a small thickness, the distance between the lamp beads installed on the front and back sides is closer, which is more in line with the original halogen lamp type.

Conventionally, in the existing method of combining two PCB boards, the thickness of two PCB boards after the combination is within 3 to 5 mm, while in the present embodiment, the thickness of the double-sided PCB board 1 can be controlled within 0.1 to 3 mm, and the thickness of the double-sided PCB board is significantly reduced.

Figure 2:
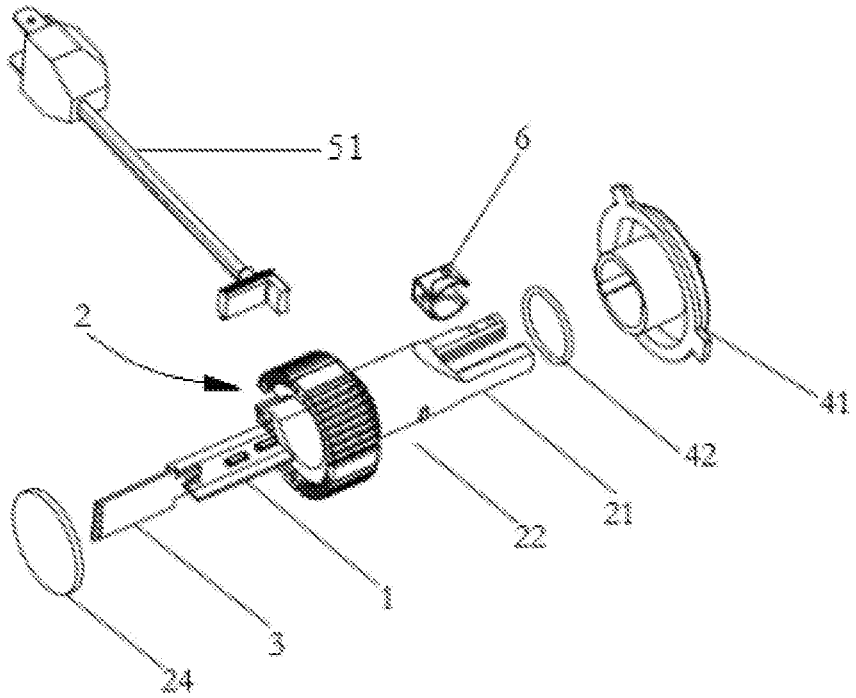
FIGS. 2-4 are schematic structural diagrams of a lamp with a pure heat sink according to an embodiment of the present applicant.
Figure 3:
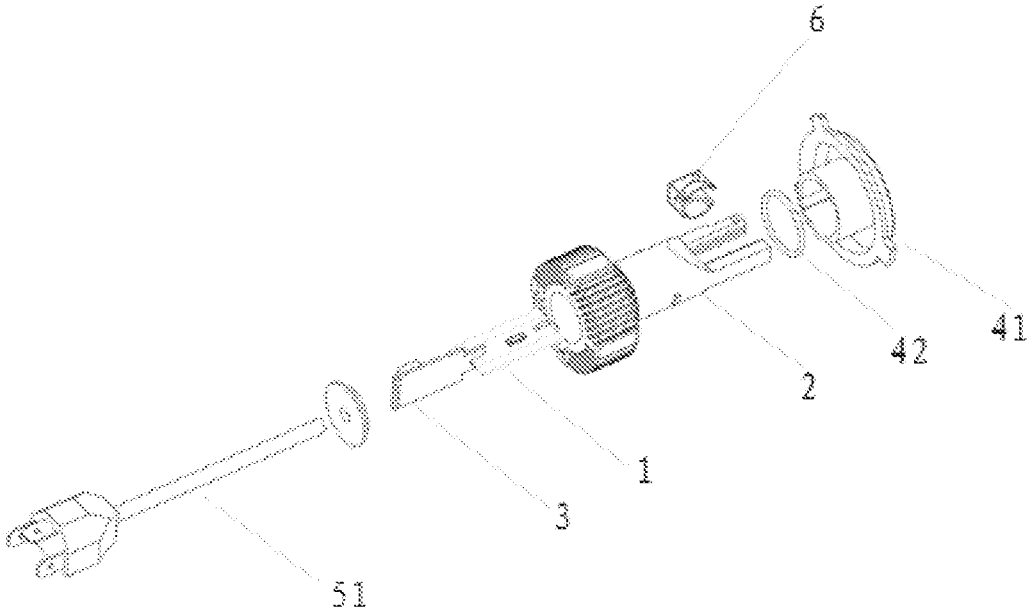
Figure 4:
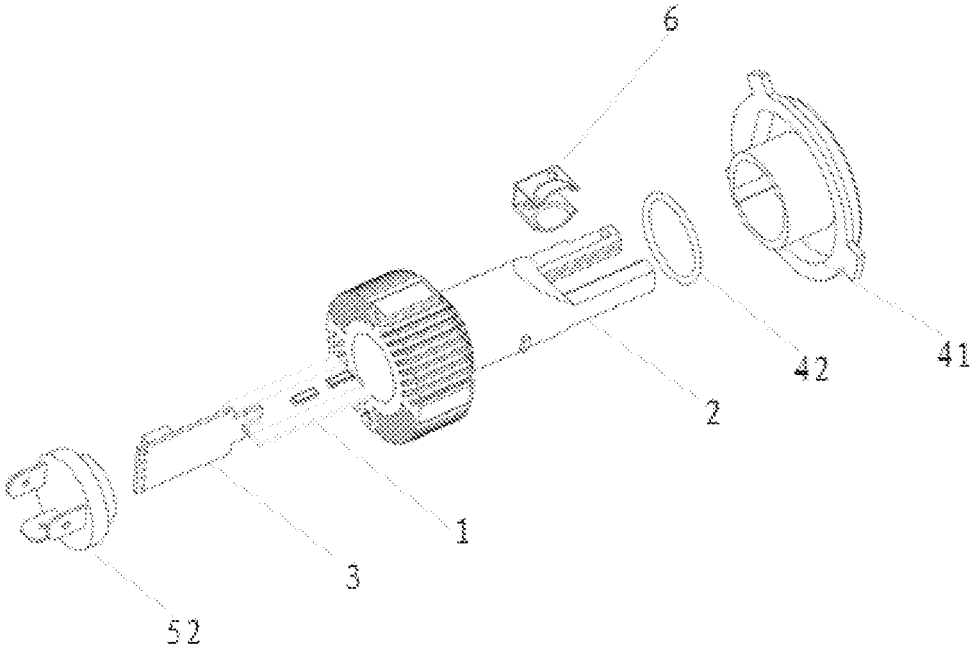

The structure of the lamp is further optimized. As shown in FIGS. 1-4, the heat sink 22 has a hollow structure and the end away from the heat dissipation arms 21 is a through end. In one embodiment, as shown in FIG. 1, the integrated heat dissipation device 2 further comprises a heat dissipation fan 23, which is mounted on the heat sink 22, for example, the through end of the heat sink 22 can be blocked by the heat dissipation fan 23. The heat dissipation efficiency of the heat dissipation device 2 can be further improved by configuring the heat dissipation fan 23. The heat dissipation fan 23 and the heat sink 22 are preferably detachably assembled. For example, the heat dissipation fan 23 is mounted on the heat sink 22 through a plurality of fixed screws for easy disassembly and maintenance. In another embodiment, as shown in FIGS. 2-4, the heat dissipation can be performed by the pure heat sink 22, that is, no heat dissipation fan 23 is installed, but the heat dissipation capability of the heat sink 22 and the dissipation arms 21 themselves can meet the heat dissipation requirement of the lamp (e.g., whether or not to configure the heat dissipation fan 23 according to the power of lamp, etc.). For example, as shown in FIG. 2, the through end of the heat sink 22 is blocked by the heat sink tail cover 24.

In particular, the shape of the tail of the heat sink 22 is not limited, and the fishbone, sun flower, strip shape and the like are all in the range of application.

Preferably, as shown in FIGS. 1-4, the PCB board 1 is connected with a driving adapter board 3, which is accommodated in a hollow cavity of the heat sink 22. The driving adapter board 3 is arranged in the heat sink 22, which can better protect the driving adapter board 3. At the same time, the structure of the lamp is compact, the volume of the lamp is reduced and the application scope is wide.

The driving adapter board 3 is configured for connecting with a power connection structure, such as docking with an input line 51. In one embodiment, a threading opening may be formed in the heat sink 22 for the arrangement of the input line 51. In another embodiment, as shown in FIG. 3 and FIG. 4, the power connection structure is directly disposed at the tail of the heat sink 22, that is, the end of the heat sink 22 away from the heat dissipation arms 21; the power connection structure can be the input line 51 or integrated socket 52 and the like.

In addition, as shown in FIGS. 1-7, the lamp further comprises a mounting structure suitable for detachably mounting to the lamp holder. In one embodiment, the mounting structure comprises a buckle 41 that is sleeved on the integrated heat dissipation device 2. The buckle 41 is used for engaging with the lamp holder, and the lamp can be mounted on the lamp holder. The engaging portion of the buckle 41 is provided with a sealing ring 42 or the like, which is a conventional structure in the art and will not be described in detail here. As well, a visor 6 and the like can be configured, and the mounting structure thereof is omitted here.

The lamp provided by the present embodiment is preferably used as an automobile headlight, and is also suitable for motorcycles, ships and other lamp applications.

The above are preferred embodiments of the present disclosure, and are not intended to limit the present disclosure. Any modifications, equivalent substitutions, improvements and so on made within the spirit and principle of the present disclosure should be included in the scope of protection of the present disclosure.

What is claimed is:

1. A lamp comprising a PCB board and an integrated heat dissipation device, wherein the PCB board is a double-sided PCB board on both sides of which are suitable for installing LED lamp beads, the PCB board has two heat dissipation edges arranged opposite to each other, the integrated heat dissipation device comprises a heat sink and two heat dissipation arms, wherein the heat dissipation arms and the heat sink are integrally formed and made from a same medium, and the two heat dissipation arms are respectively attaching to the two heat dissipation edges, the PCB board is a rectangular board, which has four edges comprising two long edges and two short edges, the two long edges disposed opposite to each other are used as the two heat dissipation edges for assembling with the two heat dissipation arms, the two heat dissipation arms are respectively riveted and assembled with the two heat dissipation edges.

2. A lamp comprising a PCB board and an integrated heat dissipation device, wherein the PCB board is a double-sided PCB board on both sides of which are suitable for installing LED lamp beads, the PCB board has two heat dissipation edges arranged opposite to each other, the integrated heat dissipation device comprises a heat sink and two heat dissipation arms, wherein the heat dissipation arms and the heat sink are integrally formed and made from a same medium, and the two heat dissipation arms are respectively attaching to the two heat dissipation edges, the PCB board is a rectangular board, which has four edges comprising two long edges and two short edges, the two long edges disposed opposite to each other are used as the two heat dissipation edges for assembling with the two heat dissipation arms, wherein each of the two heat dissipation arms has a fitting groove, the two heat dissipation edges are separately inserted into the two fitting grooves.

3. The lamp of claim 1, wherein the integrated heat dissipation device further comprises a heat dissipation fan, the heat dissipation fan is embedded in the heat sink.

4. The lamp of claim 1, wherein the heat sink has a hollow structure, and a through end of the heat sink is blocked by a heat sink tail cover.

5. The lamp of claim 1, wherein the heat sink has a hollow structure, the PCB board is connected with a driving adapter board, and the driving adapter board is accommodated in the hollow structure of the heat sink.

6. The lamp of claim 1, wherein the substrate of the PCB board is a copper plate, an aluminum plate or a composite substrate.

7. The lamp of claim 1, wherein the PCB board has a thickness of 0.1 to 3 mm.

8. The lamp of claim 1, wherein the lamp further comprises a power connection structure, the power connection structure is disposed at a tail of the heat sink.

9. The lamp of claim 1, wherein the lamp further comprises a mounting structure suitable for detachably mounting to a lamp holder.

* * * * *